US005370465A

United States Patent [19]

Banker

[11] Patent Number: 5,370,465

[45] Date of Patent: Dec. 6, 1994

[54] METHOD AND APPARATUS FOR PRINTING TRAFFIC CITATIONS

[76] Inventor: Robert L. Banker, 611 Wymore Rd., Suite. 217, Winter Park, Fla. 32789

[21] Appl. No.: 160,968

[22] Filed: Dec. 3, 1993

[51] Int. Cl.[5] ..... B41J 3/28; B41J 11/38

[52] U.S. Cl. ..... 400/23; 400/88; 400/48; 101/66; 101/69; 346/104

[58] Field of Search ..... 400/126, 48, 88; 101/66, 69, 269; 235/375, 487, 382, 483; 346/104

[56] References Cited

U.S. PATENT DOCUMENTS

| | | | |
|---|---|---|---|
| 3,828,664 | 8/1974 | Dikoff | 400/23 |
| 3,923,135 | 12/1975 | Holman et al. | 400/23 |
| 4,718,783 | 1/1988 | Tsushima et al. | 400/23 |
| 4,744,296 | 5/1988 | Edwards et al. | 101/269 |
| 4,828,406 | 5/1989 | Mosciatti et al. | 400/88 |
| 5,010,240 | 4/1991 | Sheldon | 235/375 |
| 5,091,634 | 2/1992 | Finch et al. | 235/375 |
| 5,161,905 | 11/1992 | Eriksson et al. . | |
| 5,188,464 | 2/1993 | Aaron | 400/23 |

*Primary Examiner*—Eugene H. Eickholt

*Attorney, Agent, or Firm*—Steven C. Stewart; James H. Beusse

[57] ABSTRACT

A method and apparatus for printing traffic citations or the like. An impact printer is supplied which prints with a print head onto an approximately 3.25" wide paper strips and senses the movement of the paper through the printer. A plate is provided to guide paper over the print head. The sensors are removed from the printer. The plate is widened with by attaching material along the plates side to accommodate 4.5" paper. The material is shaped to prevent the paper from squirreling.

6 Claims, 2 Drawing Sheets

METHOD AND APPARATUS FOR PRINTING TRAFFIC CITATIONS

BACKGROUND OF THE INVENTION

This invention relates to an impact printer system and more particularly, to a compact and transportable impact printer that imprints information on multi-sheet NCR (no carbon required) traffic citations.

Information on traffic citations are typically handwritten by the officer onto multi-sheets of preprinted carbon paper. The officer must be careful to depress the paper properly so that the officer's markings are imprinted on all the citation sheets.

Drafting citations are time consuming as the officer must fill out the form completely. Also, if the officer makes a mistake, the paper must be completely redrafted further increasing the officer's time to process a citation.

One possible method of imprinting citations is to feed the relevant information into a computer, and then to download the imputed information to a printer. Impact printers would be a preferable method of imprinting the downloaded information onto citations.

However, impact printers must be sized properly to align the citation form properly. A citation form size is regulated by the state. Most standard width citations are wider then the forms most compact printers print on. Consequently, portable and compact impact printers are not presently available to imprint most state citation forms.

Further, available printers tend to cut the edges of the multi-sheet forms making the forms unworkable. Many impact printers have touch sensors which detect the amount of paper under the printers print head. When printing multi-sheets, these sensors tend to interrupt the movement of paper through the printer. Further, these sensors may tend to curl or wrinkly the citation.

SUMMARY OF THE INVENTION

An object of this invention is to provide an improved method and apparatus for imprinting traffic citation forms.

Another objective of this invention is to imprint a traffic citation with a printer that maintains an even alignment throughout the printing process.

A further objective of this invention is to modify an existing impact printing device to accommodate wider forms while maintaining alignment of the print and preventing the form from squirreling.

It is an additional object to print traffic citations having multiple sheets without the sides of the citation curling.

These and other objects are accomplished with a method for modifying an impact printer having an ink ribbon and an impact device for impacting ink from the ribbon onto the paper. The impact printer has a top and bottom horizontal guide plate with side walls connecting the guide plates for guiding the paper through the impact device. The guide plate also has a back wall having a slit through which paper exits the printer. In the method, the side walls are cut to separate the top and bottom guide plates. A substantially u-shaped plate is formed having a top edge that aligns with the horizontal guide plate and a bottom edge that aligns with the bottom horizontal guide plate. The u-shaped plate is attached to the cut horizontal guide plate to form a flat surface between the bottom edge and the bottom horizontal guide plate, and between the top edge and the top horizontal guide plate.

DESCRIPTION OF THE PREFERRED EMBODIMENTS

Figure 1:
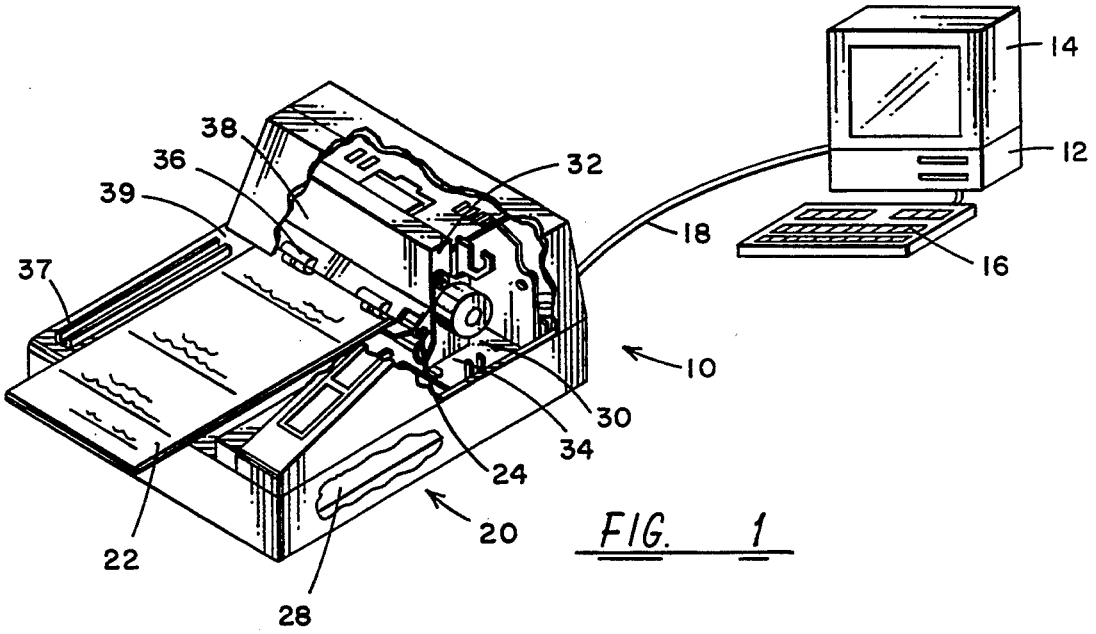
FIG. 1 is a diagram of the system for printing traffic citations having a computer connected to the printer.

Referring to FIG. 1 there is shown a diagram of the system for imprinting traffic citations designated generally by 10. The system includes a handheld or laptop computer 12, monitor 14 and keyboard device 16 connected through cable 18 to impact printer 20. The impact printer 20 receives a citation form 22 that is right aligned on guide plate 24. A preferred printer 20 is Epson Model No. TM-290, distributed by Arco Distributors of Miami, Fla., which has been found acceptable for this application.

Impact printer 20 includes a circuit 28 connected to print head assembly 30. Print head assembly 30 includes a top assembly section 32 which contains the movable print head and inked ribbon and a bottom section 34 on which guide plate 24 is mounted. Bottom section 34 includes roller portion 36 which moves citation 22 through the printer 20. A top assembly section 32 which holds a ribbon 38 to impact text onto the citation as it passes over roller portion 36. Resting on roller portion 36 is plate 24 which in conjunction with, a support plate 39 guides citation form 22 through print head assembly 30 and out a slit 26 (FIG. 2) formed in the rear of printer 20.

During operation a law enforcement official enters information into computer 12 using keyboard 16. The relevant information is displayed on monitor 14. The official edits this information with keyboard 16. Once the relevant information has been entered into the computer 12, it is transmitted via cable 18 into circuit 28 within printer 20. Circuit 28 responds to that information by transmitting signals to print head assembly 30 resulting in print head in section 32 impacting the relevant data onto the citation form 22 while roller 36 moves the citation through printer 20.

Figure 2:
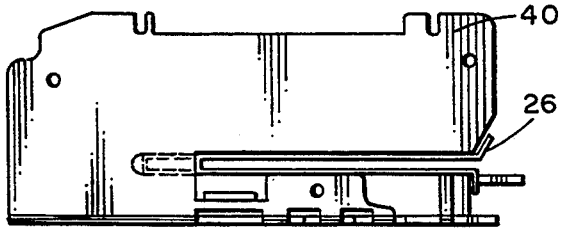
FIG. 2 is a rear view of the bottom section of the printing device with the modification for imprinting wider paper shown in phantom.

Referring to FIG. 2, there is shown the rear view of printer 20 having a back wall 40 forming a slit 26 thereon. Using the Epson Model TM-290 or TM-290II printer 20, the slit is widened by cutting out an additional portion of back wall 40. This area to be cut is designated by 48. This cut out extends the length of slit 26 from $3\frac{1}{4}''$ to preferably about $4\frac{1}{2}''$ and is shown in phantom.

Figure 4:
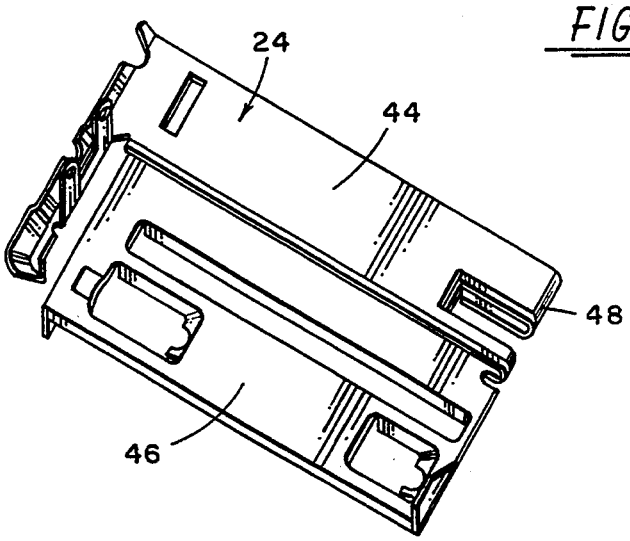
FIG. 4 is a perspective view of the unmodified guide plate shown in FIG. 3.
Figure 3:
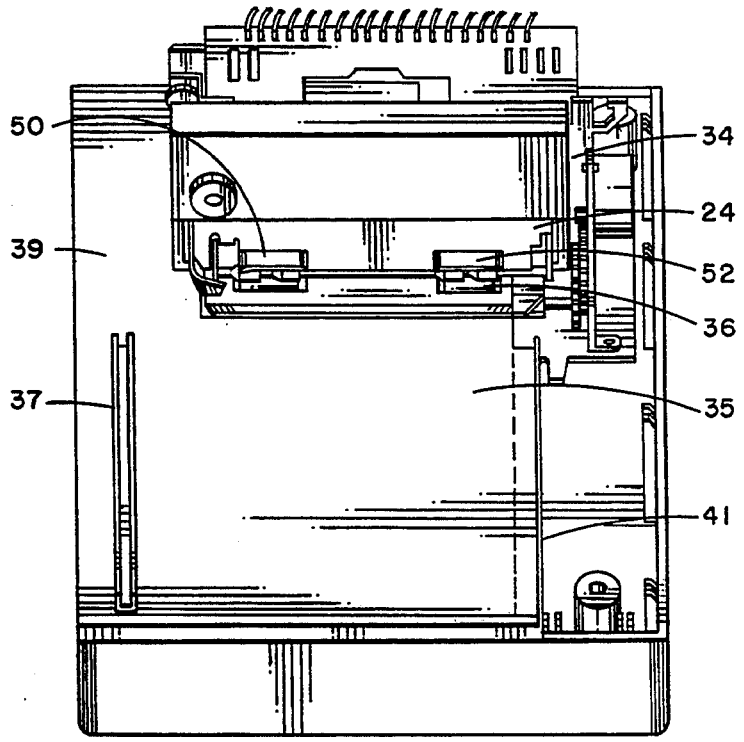
FIG. 3 is a top view of the printing device shown in FIG. 2.
Figure 5:
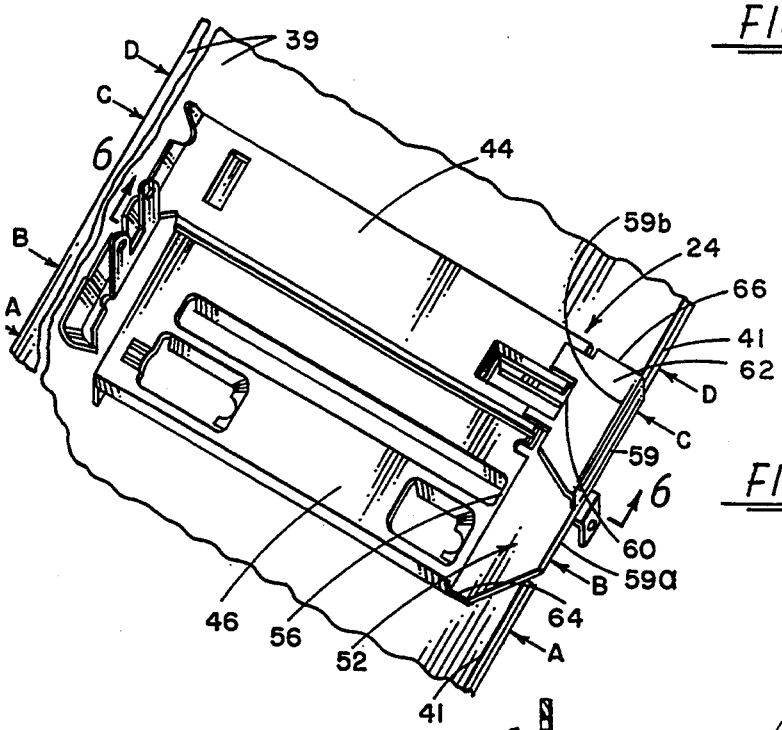
FIG. 5 is a top view of the modified guide plate.

Referring to FIG. 3 there is shown a top view of plate 24 resting on bottom section 34 and support plate 39. Referring to FIG. 5, plate 24 includes a top section 44 and a bottom section 46. Plate 24 is shown in FIG. 4 unmodified and having a top plate 44 connected to bottom plate 46 using vertical plate 48. Referring to FIG. 3, plate assembly 24 rests on bottom section 34 and contains apertures 50 and 52 through which roller 36 protrudes therethrough to move paper or citation 22 through the printer 20. Bottom section rests on support plate 35 which has a left guide 37 to guide paper or citation 22 through the printing operation. Plate 35 is modified by widening one side wider than the shown in phantom. Plate 35 has a vertical side wall or edge 41 that extends upward along one side of plate 35, parallel to the direction of travel of citation form 22.

Referring to FIG. 4, plate 24 is preferably removed from bottom section 34 and is cut on its right side wall to remove vertical plate 48. Removing plate 48 separates top horizontal guide plate 44 from bottom horizontal guide plate 46.

Referring to FIG. 5, once separated, a u-shaped plate 52 is provided having a bottom side edge 56 with a surface 58, a side edge 59 and a top side edge 60 with a surface 62. Preferably, u-shaped plate 52 is constructed from a brass or mild metal material, such as stainless steel, that is easily malleable. Side edge 59 preferably extends along the length of plate 52 to guide paper through printer 20.

The top edge 60 is aligned with one side of top horizontal guide plate 44 and the bottom edge 56 is aligned with the same side of bottom horizontal guide plate 46. A front side edge **59*a* of u-shaped plate preferably tapers from front edge 64 toward rear edge 66 along the path of travel of citation form 22. More specifically, the width of plate 39 is designated by A—A and D—D. The width across plate 39 and u-shaped plate 52 is designated by B—B and C—C. It is critical to the invention that a side edge 59 extend outside the edge of edge 41 and taper inside of edge 41 and rear edge 59*b***. Preferably, dimension C—C is about 1/16" less than dimension B—B. It is critical that dimension B—B is greater than dimension A—A, and that dimension C—C is less than dimension D—D. Tapering the edge in this manner prevents the form from being jammed in the printer.

Top edge 60 is welded to the edge of top horizontal guide plate 44. The bottom edge 56 is welded along the cut edge of bottom horizontal guide plate 46.

Figure 6:
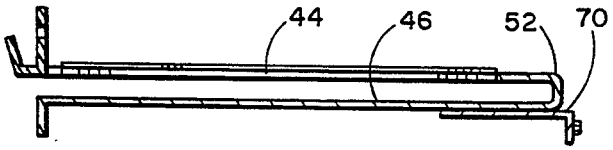
FIG. 6 is a sectioned view of the modified guide plate along line 6—6 of FIG. 5.

Referring to FIG. 6, it is noted that when the u-shaped plate 52 is attached to the top and bottom horizontal guide plates, 44 and 46 respectively, a smooth flat surface is formed between the u-shaped plate and the horizontal guide plates. It is noted that by tapering the u-shaped plate on its top surface from the front edge of the bottom plate 46 to the front edge of the top plate 44 paper is prevented form curling when fed through the printer 20.

Referring once again to FIG. 3, it is preferable that all the sensors which detect and touch the citation are removed from the printer 20. Removing the sensors prevents inadvertent squirreling or crinkling of the citation 22.

Referring to FIG. 6, an L-shaped bracket 70 already welded to the middle portion of the bottom surface of bottom plate 46, is welded to the bottom surface of u-shaped plates 52, so that u-shaped plate 52 can snap fit into print head assembly 30.

Once the plate 24 has been modified, it is placed back into the print head assembly 30 and then placed back into the printer 20.

This concludes the description of the preferred embodiments. A reading by those skilled in the art will bring to mind various changes without departing from the spirit and scope of the invention. It is intended, however, that the invention only be limited by the following appended claims.

What is claimed is:

1. A method for modifying an impact printer having an inked ribbon and an impact device for impacting ink from the ribbon onto paper, and a top and bottom horizontal guide plate with a vertical side wall connecting the guide plates for guiding the paper through the impact device and a back wall having a slit through which paper exits the printer, the method comprising the steps of:

cutting the vertical side wall to separate the top and bottom guide plates;

forming a substantially u-shaped plate having a top edge that aligns with the top horizontal guide plate and having a bottom edge that aligns with the bottom horizontal guide plate; and attaching the u-shape plate to the cut horizontal guide plate to form a flat surface between the bottom edge and to the bottom horizontal guide plate and between the top edge and the top horizontal guide plate.

2. The method as recited in claim 1 further comprising the steps of providing a support plate having a vertical side wall for supporting the impact device, and forming a side wall with the u-shape plate that has a front portion extending outside a width of the vertical side wall and tapers to a rear portion extending inside the side wall.

3. The method as recited in claim 1 further comprising the step of tapering a side edge of the u-shaped plate laterally across said u-shape plate along a direction of movement of the paper.

4. The method as recited in claim 3 further comprising steps of forming the width of guide plates to extends to accept approximately wide forms 3.25 inches; and extending the width of the guide to accept forms having a width of 4.5 inches.

5. An impact printer for printing information on multi-layered paper forms comprising:

an inked ribbon;

an impact device for impacting ink from the ribbon onto the paper;

a top and bottom horizontal guide plate;

a substantially u-shaped plate having a top edge that aligns with the top horizontal guide plate and having a bottom edge that aligns with the bottom horizontal guide plate, said u-shape plate attached to the horizontal guide plate to form a flat surface between the bottom edge and the bottom horizontal guide plate and between the top edge and the top horizontal guide plate, said u-shape plate operative to guide the paper through the impact device;

a chassis for holding said guide plates and said impact device; and a back wall supported by said chassis and having a slit through which paper exits the printer.

6. The impact printer as recited in claim 5 wherein said printer includes a support plate that supports the impact device and support plate.

* * * * *